United States Patent [19]

Andersen

[11] 4,068,439

[45] Jan. 17, 1978

[54] WALL COVERING

[75] Inventor: Heinz-Erhardt Andersen, Burgkirchen, Alz, Germany

[73] Assignee: Hoechst Aktiengesellschaft, Frankfurt am Main, Germany

[21] Appl. No.: 724,542

[22] Filed: Sept. 20, 1976

[30] Foreign Application Priority Data

Sept. 24, 1975 Germany ..... 2542526

[51] Int. Cl.[2] ..... E04B 5/52

[52] U.S. Cl. ..... 52/497; 52/506

[58] Field of Search ..... 52/494, 497, 506, 510, 52/483, 479, 480, 718, 669, 666

[56] References Cited

U.S. PATENT DOCUMENTS

| | | | |
|---|---|---|---|
| 3,412,515 | 11/1968 | Finon | 52/480 |
| 3,849,954 | 11/1974 | Sugita | 52/506 X |

FOREIGN PATENT DOCUMENTS

| | | | |
|---|---|---|---|
| 723,839 | 12/1965 | Canada | 52/483 |
| 2,010,324 | 9/1971 | Germany | 52/506 |

*Primary Examiner*—Price C. Faw, Jr.
*Assistant Examiner*—Carl D. Friedman
*Attorney, Agent, or Firm*—Connolly and Hutz

[57] ABSTRACT

A wall covering system of plastics elements consisting of strips of sheeting or panels the lateral edges of which are folded by an angle of more than 90° and profiles having a dovetail cross section for holding and fastening the strips, wherein the profiles are fixed on structural shapes, fastened to the wall and likewise having a dovetail cross section, by means of spacers of V-shaped cross section with chamfered end sections, which spacers are fitted into the structural shapes in a manner to enable them to slide in longitudinal direction.

4 Claims, 1 Drawing Figure

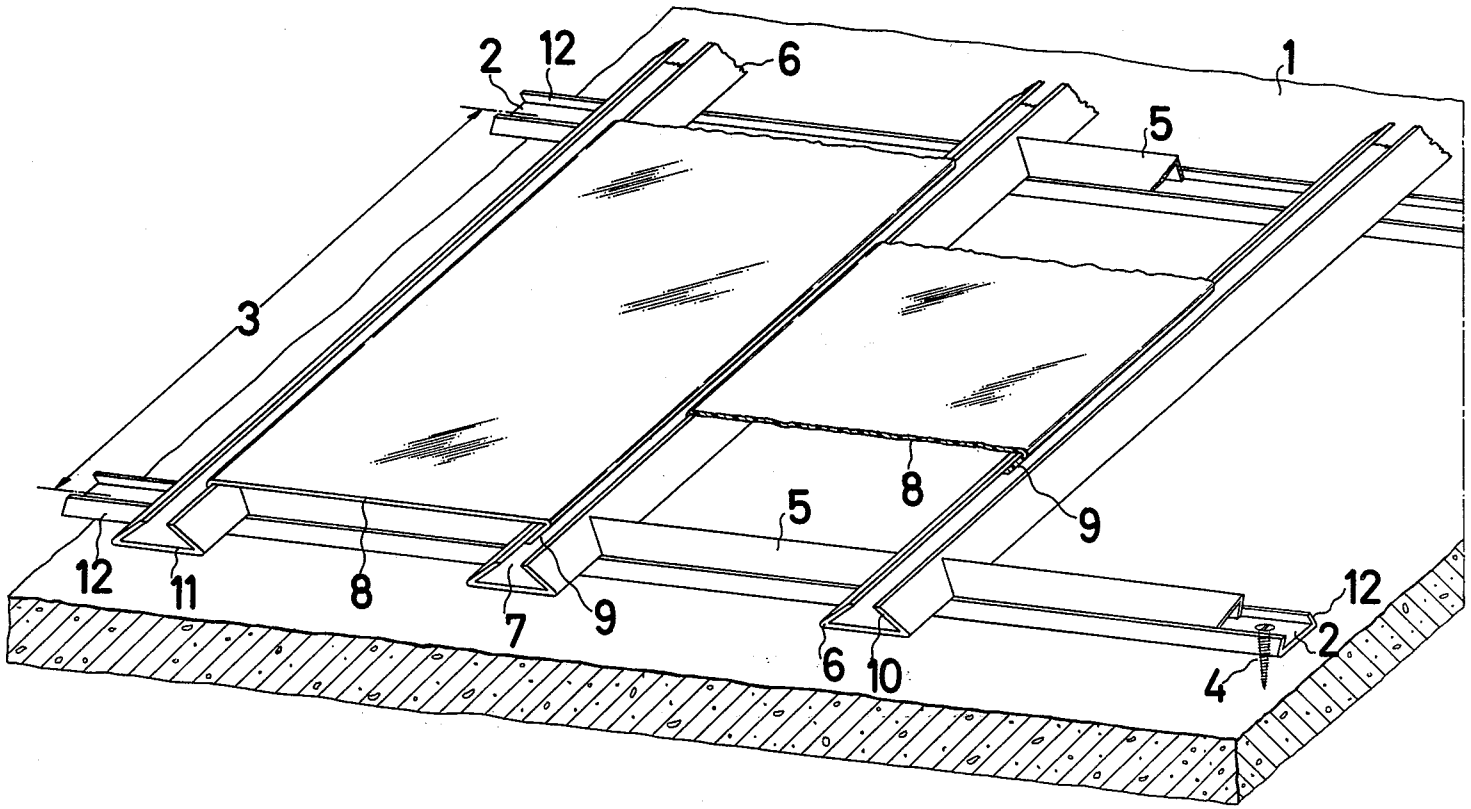
1
2
12
4
5
9
8
10
6
5
6
9
12
2
7
8
3
11
12

WALL COVERING

This invention relates to a wall covering system of plastics elements consisting of strips of sheeting or panels the lateral edges of which are folded by an angle of more than 90° and profiles having a dovetail cross section for holding and fastening the strips.

A wall covering system of this type is described in German Offenlegungsschrift 1,659,866. It has been found, however, that with this system the insertion of the strips 1 in the profiles 2 fitted onto the wall is rather difficult if the profiles are not fastened in an exact parallel position with respect to one another. It comes true that this requirement could be fulfilled with relatively long profiles but the fitting of the said profiles onto the wall to be covered requires careful attention and minute work. Hence, the fitting of the known wall covering system is very time consuming.

It is the object of the present invention to provide a wall covering system of plastics elements which are easy to fit and the mounting of which does not require too high an accuracy.

This problem is solved by a wall covering system of plastics elements consisting of strips of sheeting or panels the lateral edges of which are folded by an angle of more than 90° and profiles in the shape of a dovetailed guide in which the strips engage and by which they are held, wherein the profiles are held in structural shapes, fixed on the wall in transverse direction and likewise having a dovetailed cross section, by means of spacers of V shaped cross section with chamfered end portions, which spacers slide in the dovetailed groove of the structural shapes.

The structural shapes of the surface facing system according to the invention can be fitted onto the wall as judged by the eye and without a demand on accuracy like normal flat bars by screws, nails or staples, either manually or with the aid of a stapling apparatus. The lateral edges of the structural shapes are preferably folded by an angle of 120° to 150° and generally have a height of 0.2 to 1 cm. The breadth of the structural shapes is preferably in the range of from 2 to 5 cm.

According to a preferred embodiment of the invention the spacers of V shaped cross section have an acute angle of from 20° to 60°. The degree of inclination of their end faces corresponds to the inclination of the side faces of the profiles. The length of the spacers depends on the breadth of the strips of sheeting.

The elements of the wall covering system according to the invention are preferably made of thermoplasts by extrusion and/or calendering.

The wall covering system of the invention can be fitted onto exterior or interior walls. In addition to the advantages cited in the aforesaid specification, it has the further important advantage that much less time is required for mounting. It comes true that the system of the invention is composed of a larger number of individual plastics elements than the known system, but it can be mounted more rapidly and more easily on the wall to be covered since the fastening of the structural shapes on the wall does not require such a high accuracy as to parallelism and, moreover, the insertion of the strips into the profiles is less complicated.

The wall covering system of the invention will now be described by way of example only with reference to the accompanying drawing which shows a plan view slightly in perspective of the system and simultaneously illustrates its mounting on a wall.

On the walls to be covered structural shapes 2 are fastened, preferably by screws or nails, substantially in parallel position at a distance 3 of approximately 50 cm from one another. Spacers 5 of V shaped cross section are inserted into the dovetail groove of the structural shapes 2 so as to constitute a form-closed fitting, but in such a manner that they may slide in longitudinal direction. The spacers 5 fix the distance of the profiles 6 on the structural shapes 2. The profiles 6 in the form of a dovetail guide have a cross section in the form of an isosceles triangle which is open at the vertex forming a slit 7 which has a width such that two panel strips 8 can be easily inserted. The lateral edges 9 of the panel strips 8, which are folded by an angle of more than 90°, preferably 120° to 150°, should be a little smaller than the lateral faces 10 of the profiles 6. The lateral faces 10 suitably have a breadth of from 0.5 to 3 cm and the bases 11 of the profiles have a breadth of from 2 to 10 cm. The width of the panel strips 8 can vary within wide limits. The length of the strips and of the profiles 6 depends on the dimensions of the wall to be covered. The folded edges of panel strips 8 constitute, together with the profiles 6, a form-closed fitting with the possibility of the panel strips 8 to slide in longitudinal direction in profiles 6.

The structural shape 2 represented in the drawing has a breadth of 3 cm, its length depends on the dimensions of the wall to be covered. The lateral edges 12 folded by an angle of 120° have a breadth of 0.5 cm.

The spacers 5 having a V shaped cross section are inserted into the structural shapes 2 so as to constitute a form-closed fitting. The end sections of the spacers are chamfered to such a degree that the two front edges at the opening form an angle of 130° with the longitudinal edges of the legs of the spacer. The length of the spacers depends on the breadth of the panel strips and the acute angle is 30°.

For mounting, first the spacers 5 of V shaped cross section are inserted into structural shapes 2 while maintaining between the individual spacers a distance which is larger than the breadth of the panel strips 8. Next, a panel strip 8 is inserted into the slit 7 of two profiles 6, one profile is pushed under the chamfer of the spacers 5 whereupon the other profile is pressed under the opposite chamfer of the same spacer. The next spacers are then pushed close against the profile 6, the next panel strip 8 is inserted with ine edge 9 into the slit 7 of the profile and the other edge 9 is inserted into the next profile. Said profile is then pushed under the free chamfer of the spacers 5 pushed against the inclined leg of profile 6. This operation is repeated until the entire wall is covered with panel strips.

What is claimed is:

1. A wall covering system of plastic elements consisting of panels having lateral edges folded by an angle of more than 90°;

profiles having a dovetail cross section for holding the panels;

structural shapes having a dovetail cross section, said structural shapes are fastened in parallel position on the wall; and spacers having V-shaped cross section with such chamfered end faces that their inclination degree corresponds to the inclination of the lateral faces of the profiles and having a length which corresponds to that of the panels, said spacers are fitted into the structural shapes in which they are sliding in longitudinal direction and fix the profiles on the structural shapes, whereby the folded edges of said panels constitute together with said profiles a form-closed fitting.

2. A wall covering system as claimed in claim 1, in which the panels have lateral edges being folded by an angle of 120° to 150° and being a little smaller than the lateral faces of said profiles;

the profiles have a cross section in the form of an isosceles triangle which is opened at the vertex forming a slit which has a width such that two panels can be inserted; and the structural shapes have lateral edges being folded by an angle of 120° to 150° and having a height of 0,2 to 1 cm.

3. A wall covering system as claimed in claim 2, wherein the the panels are relatively thin, stiff and flexible.

4. A wall covering system as claimed in claim 3, wherein the profiles and structural shapes incorporate relatively thin, stiff and flexible sections.

* * * * *